United States Patent [19]

Day

[11] Patent Number: 5,014,639

[45] Date of Patent: May 14, 1991

[54] DETACHABLE WATER SCOOTER ASSEMBLY

[76] Inventor: Yeu S. Day, 9-1, Lane 161, Hsing An Road Sec. 1, Taichung, Taiwan

[21] Appl. No.: 472,870

[22] Filed: Jan. 31, 1990

[51] Int. Cl.[5] ..... B63B 7/04; B63B 7/08

[52] U.S. Cl. ..... 114/352; 114/270; 114/345

[58] Field of Search ..... 114/270, 77 R, 77 A, 114/345, 353; 441/54

[56] References Cited

U.S. PATENT DOCUMENTS

| | | | |
|---|---|---|---|
| 2,434,700 | 1/1948 | Keckley | 114/270 |
| 2,451,781 | 10/1948 | Steele | 114/270 |
| 3,442,246 | 6/1969 | Paolone | 114/270 |
| 4,750,448 | 6/1988 | Hennebutte | 114/345 |
| 4,765,075 | 8/1988 | Nakase et al. | 114/270 |
| 4,936,242 | 6/1990 | Stelniceanu | 114/352 |

*Primary Examiner*—Sherman Basinger
*Assistant Examiner*—Thomas J. Brahan

[57] ABSTRACT

A detachable water scooter assembly comprises an engine compartment with a bill-shaped front hull, an engine in the engine compartment, a central axle connected to the engine, a driving assembly, a handle bar assembly, two air chambers, a plenum chamber, and at least two securing belts. The driving assembly comprises a shaft, a universal joint, a driven axle, a propeller screw, and a rudder. The handle bar assembly comprises a steering bar, a fixed plate, and a plurality of bolts. The shaft has a plurality of holes on its periphery.

3 Claims, 4 Drawing Sheets

DETACHABLE WATER SCOOTER ASSEMBLY

FIELD OF THE INVENTION

The present invention relates to a detachable water scooter assembly which comprises an engine compartment with a bill-shaped hull, a driving assembly, a handle bar assembly, two air chambers, and a plenum chamber.

BACKGROUND OF THE PRESENT INVENTION

Please referring to FIG. 1, a conventional jet ski comprises a hull 1, a seat 2, and a handle bar assembly 3. The front portion of the hull 1 provides an engine compartment 4. The hull 1 is generally made of fiber glass. Since the conventional jet ski it not detachable, it is cumbersome to store or to transport.

OBJECT OF THE PRESENT INVENTION

The principal object of the present invention is to provide a detachable water scooter assembly which is detachable for convenient storage and transportation.

Accordingly, a detachable water scooter assembly comprises an engine compartment with a bill-shaped front hull, two conical holes and a circular hole which are located at the rear end of the engine compartment respectively, an engine which is located in the engine compartment, a central axle which is connected to the engine and passed through the circular hole, a driving assembly, a handle bar assembly, two air chambers, a plenum chamber, and at least two securing belts. The driving assembly comprises a shaft, a universal joint, a driven axle, a propeller screw, and a rudder. The handle bar assembly comprises a steering bar, a fixed plate, and a plurality of bolts. One end of the universal joint is connected to the central axle and the other end of the universal joint is connected to the driven axle. One end of the shaft is inserted in the circular hole and the other end of the shaft is connected to the rudder. A handle bar assembly is located on the rear top portion of the engine compartment. The rudder and the handle bar assembly is connected by two parallel cords respectively. Two air chambers are inserted in two conical holes respectively. The plenum chamber is disposed on the upper portion of each of the two air chambers respectively. The pipe is disposed at the lower portion of each of the two air chambers respectively. The plenum chamber, two air chambers, and the shaft are bound together tightly by at least two securing belts.

DESCRIPTION OF THE PREFERRED EMBODIMENT

Figure 1:
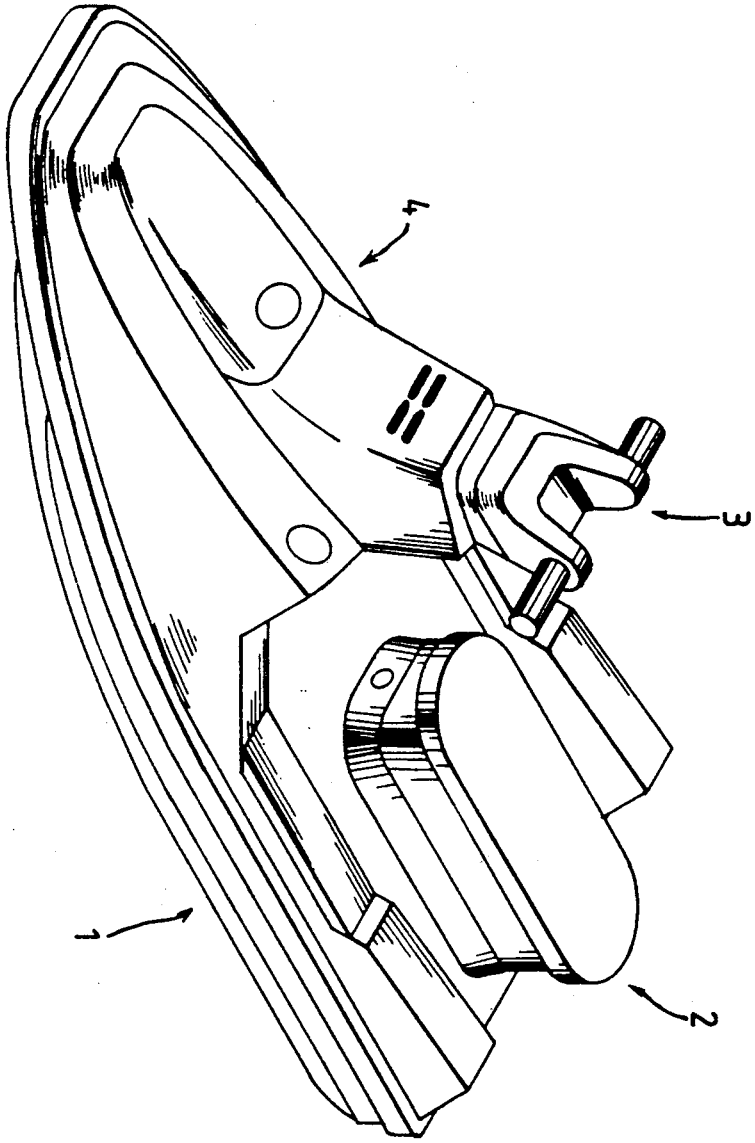
FIG. 1 PRIOR ART
FIG. 1 is a perspective view of a conventional jet ski.
Figure 2:
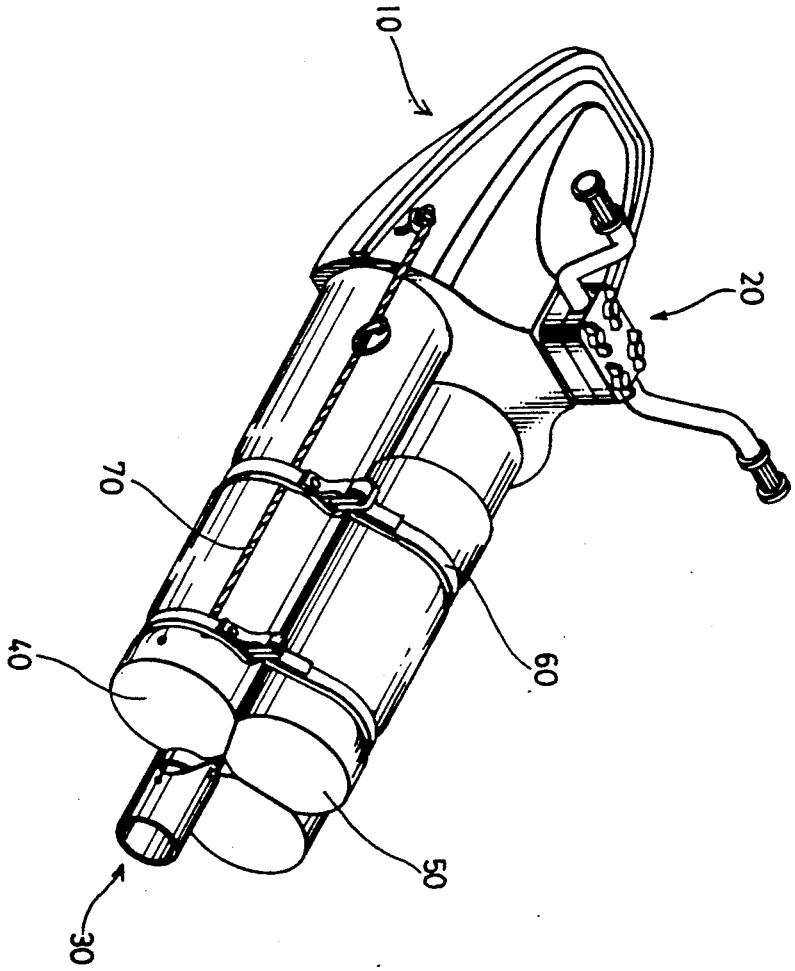
FIG. 2 is a perspective assembly view of a detachable water scooter assembly of a preferred embodiment in accordance with the present invention.
Figure 3:
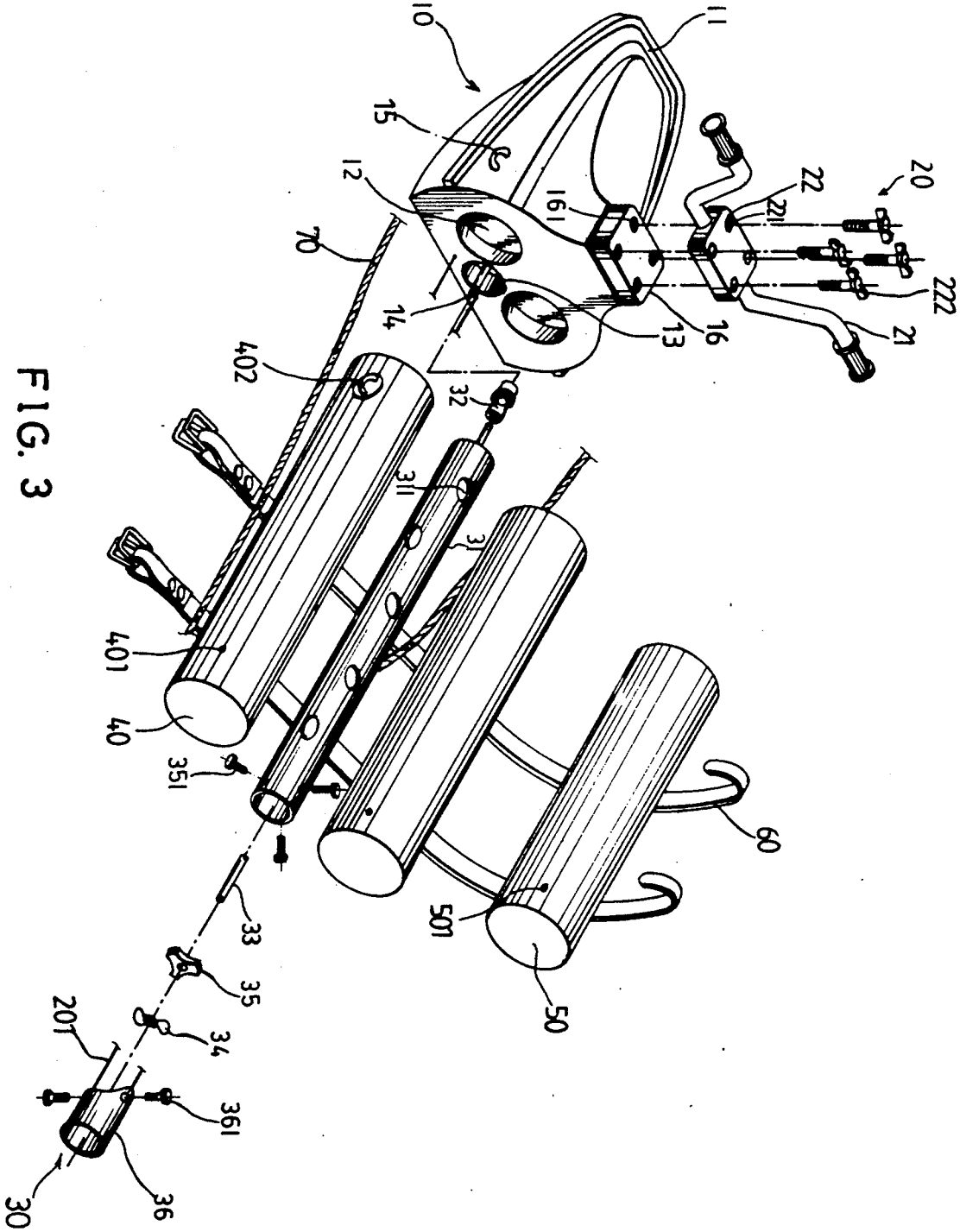
FIG. 3 is a perspective fragmentary view of FIG. 2.
Figure 4:
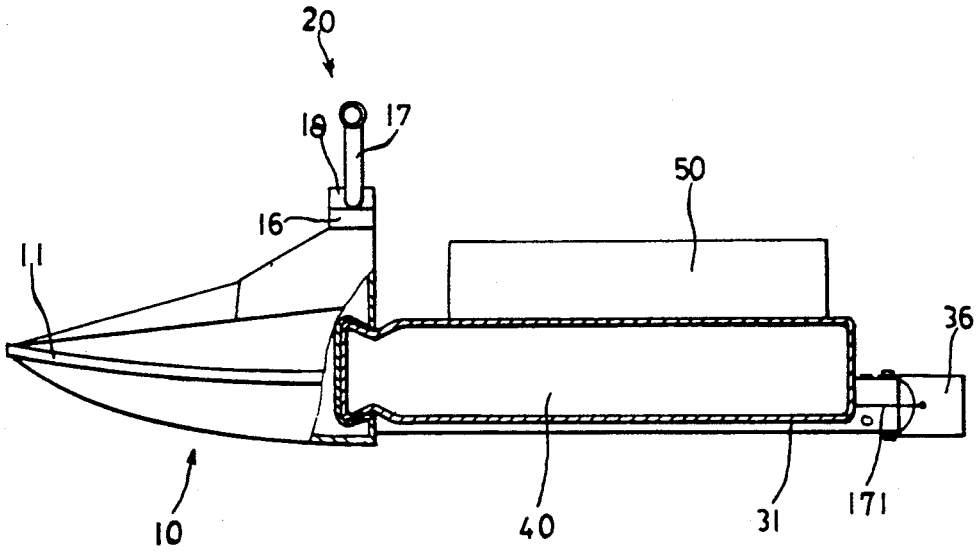
FIG. 4 is a partly sectional, end view of FIG. 2.
Figure 5:
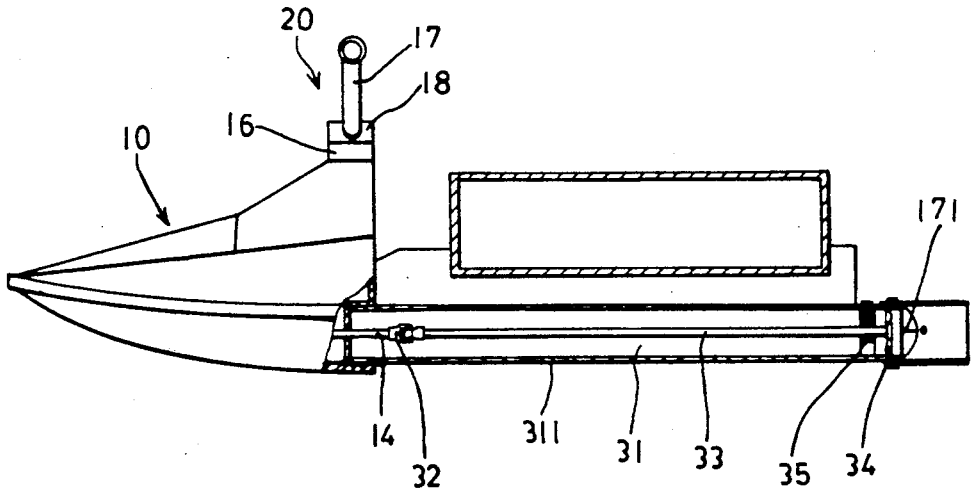
FIG. 5 is another partly sectional, end view of FIG. 2.
Figure 6:
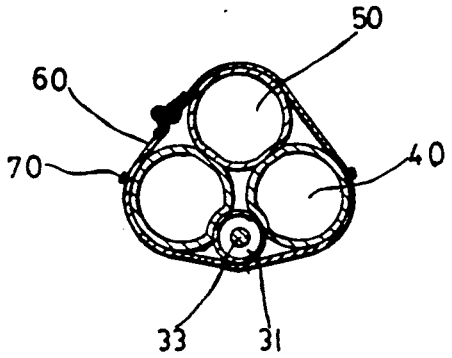
FIG. 6 is a partly rear sectional view of FIG. 2.

Please referring to FIG. 2, a detachable water scooter assembly comprises an engine compartment 10, a handle bar assembly 20, a driven assembly 30, two air chambers 40, a plenum chamber 50, two securing belts 60, and two securing ropes 70. Referring to FIGS. 3 to 5, the handle bar assembly 20 comprises a steering bar 21, a fixed plate 22, and a plurality of bolts 221. The driving assembly 30 comprises a shaft 31, a universal joint 32, a driven axle 33, a propeller screw 34, a support seat 35, and a rudder 36. The front hull 11 of the engine compartment is in a bill shape. Two conical holes 12 and a circular hole 13 are positioned at the rear end of the engine compartment 10 respectively. An engine, not shown in the figures, is located in the engine compartment 10. A central axle 14 which passes through the circular hole 13 is connected to the engine. Two semicircular securers 15 are mounted at the two sides of the engine compartment 10 respectively. A rotatable plate 16 with a plurality of bolt holes 161 is positioned on the rear top portion of the engine compartment 10. The fixed plate 22 with a plurality of bolt holes 221 is secured on the top of the rotatable plate 16 by a plurality of bolts 222. Two cords 201 which are connected to the handle bar assembly 20 are moved by the steering bar 21. Two deflated air chambers 40 are inserted in the two conical holes 12 respectively. An air compressor (not shown in the figures) which is located in the engine compartment 10 can compress air into two air chambers 40 and the plenum chamber 50 via each air inlet 401,501 on each chamber 40, 50 respectively. Thus the air chambers 40 are fixedly secured in the conical holes 12 respectively. Referring to FIG. 6, the plenum chamber 50 is disposed on the upper portion of each of the air chambers 40 respectively. The pipe 31 is disposed at the lower portion of each of the air chambers 40 respectively. The plenum chamber 50, shaft 31, and two air chambers 40 are bound together tightly by at least two securing belts 60 respectively. Thus the user can sit on the top of the plenum chamber 50. One side of each air chamber 40 has a semicircular securer 402 respectively. Now referring to FIG. 3, two parallel securing ropes 70 can pass through the two semicircular securers 402 and 15 respectively in order to connect the air chambers 40 and the engine compartment 10 securely. Each of the two securing ropes 70 is fixedly secured by the two securing belts 60 respectively in order to avoid the looseness of the securing ropes 70 and the securing belts 60. A plurality of holes 311 are positioned on the periphery of the shaft 31. Referring to FIGS. 3 and 5, one end of the universal joint 32 is connected to the central axle 14 and the other end of the universal joint 32 is connected to the driven axle 33. A support brace 35 is fixedly secured in the rear portion of the shaft 31 by a plurality of bolts 351. The propeller screw 34 which is connected by the driven axle 33 is located in the end portion of the shaft 31. The rudder 36 is connected to the end portion of the shaft 31 by two bolts 361. Since one end of each of the two cords 201 is movably connected to the rudder 36 respectively, the rudder 36 can be turned by the rotation of the steering bar 21. When the propeller screw 34 is driven by the engine, water can flow into the shaft 31 via a plurality of holes 311 and flow out of the shaft 31 via the rudder 36.

According to the present invention, the plenum chamber 50 and air chambers 40 are made of plastics or rubbers. Thus the deflated chambers 50 and 40 may be folded for storage. Most parts of the detachable water scooter assembly can be detached except the engine compartment 10. Thus the detached parts of the detachable water scooter assembly can be transported, stored, or repaired conveniently.

I claim:

1. A detachable water scooter assembly comprising:
an engine compartment with a bill-shaped front hull;
two conical holes and a circular hole being positioned at the rear end of said engine compartment respectively;
an engine being located in said engine compartment;
a central axle being connected to said engine and passed through said circular hole;
a driving assembly comprising a shaft, a universal joint, a driven axle, a propeller screw, and a rudder;
one end of said universal joint being connected to said central axle and the other end of said universal joint being connected to said driven axle;
one end of said shaft being inserted in said circular hole and the other end of said shaft being connected to said rudder;

a handle bar assembly being located on the rear top portion of said engine compartment;
said rudder and said handle bar assembly being connected by two parallel cords respectively;
two air chambers being inserted in said conical holes respectively;
a plenum chamber being disposed on the upper portion of each of said air chambers respectively;
said pipe being disposed at the lower portion of each of said air chambers respectively;
at least two securing belts binding said air chambers, said plenum chamber, and said shaft together.

2. A detachable water scooter assembly as claimed in claim 1, wherein said handle bar assembly comprises a steering bar, a fixed plate, and a plurality of bolts.

3. A detachable water scooter assembly as claimed in claim 1, wherein a plurality of holes are positioned on the periphery of said shaft.

* * * * *